US009127330B2

(12) United States Patent
Krispinsson

(10) Patent No.: US 9,127,330 B2
(45) Date of Patent: Sep. 8, 2015

(54) METHOD OF SHAPING AND HARDENING A SHEET STEEL BLANK

(75) Inventor: Jan Krispinsson, Lulea (SE)

(73) Assignee: Gestamp Hardtech AB, Lulea (SE)

( * ) Notice: Subject to any disclaimer, the term of this patent is extended or adjusted under 35 U.S.C. 154(b) by 889 days.

(21) Appl. No.: 13/261,035

(22) PCT Filed: Jun. 9, 2010

(86) PCT No.: PCT/SE2010/000157

§ 371 (c)(1),
(2), (4) Date: Nov. 21, 2011

(87) PCT Pub. No.: WO2010/147531

PCT Pub. Date: Dec. 23, 2010

(65) Prior Publication Data

US 2012/0073708 A1 Mar. 29, 2012

(30) Foreign Application Priority Data

Jun. 15, 2009 (SE) ..... 0900805

(51) Int. Cl.

| | |
|---|---|
| ***C21D 8/02*** | (2006.01) |
| ***C21D 1/673*** | (2006.01) |
| ***B21D 22/02*** | (2006.01) |
| ***B21D 37/16*** | (2006.01) |
| ***C21D 9/50*** | (2006.01) |

(52) U.S. Cl.

CPC ..... *C21D 1/673* (2013.01); *B21D 22/02* (2013.01); *B21D 37/16* (2013.01); *C21D 8/02* (2013.01); *C21D 9/505* (2013.01)

(58) Field of Classification Search

CPC ..... C21D 8/02
USPC ..... 148/534
See application file for complete search history.

(56) References Cited

U.S. PATENT DOCUMENTS

| | | | |
|---|---|---|---|
| 5,916,389 | A | 6/1999 | Lundstrom |
| 2008/0196800 | A1 | 8/2008 | Beenken et al. |

FOREIGN PATENT DOCUMENTS

| | | |
|---|---|---|
| JP | 2005-161365 | 6/2005 |
| JP | 2007-075834 | 3/2007 |
| JP | 2007-154257 | 6/2007 |

*Primary Examiner* — Brian Walck
(74) *Attorney, Agent, or Firm* — Mark P. Stone

(57) ABSTRACT

A method of forming a product by shaping and hardening a sheet-steel blank formed from separate sheets welded together, heating the blank to the austenitising range, hot stamping the blank in a cooled tool pair, hardening the product while it remains in the tool pair, and cooling the weld between two adjacent sheets at a reduced cooling rate as compared to the cooling rate of areas on either side of the weld.

2 Claims, No Drawings

METHOD OF SHAPING AND HARDENING A SHEET STEEL BLANK

TECHNICAL FIELD OF THE INVENTION

The invention relates to a method of shaping and hardening a sheet-steel blank, composed of separate sheets welded together, to give a product by heating the blank to the austenitising range and hot-stamping the blank in a cooled tool pair, then hardening the formed product while it remains in the tool pair.

BACKGROUND OF THE INVENTION

In press hardening, a sheet-steel blank is hot-stamped in a cooled tool pair into shape, then the formed product is hardened while it remains in the tool pair. This is now the usual process for producing high-strength products for the vehicle industry. This method results in a tensile strength of 1400 or 1500 MPa or more. It may be desirable to have a blank composed of two or more sheets having different thicknesses and/or material properties so as to result in different properties in different parts of the finished product and to reduce the weight. The different sheets are usually laser-welded together to form a composite blank usually referred to as a TWB (Tailor-Welded Blank) and this composite blank is then formed and hardened by press hardening.

OBJECT OF THE INVENTION

One aim of the invention is to improve the properties of a product of this kind. In particular, one aim is to reduce the risk of cracking around the weld in the event of a collision when the product is a high-strength product for vehicles and to reduce the risk of crack formation and other defects and indications of fracture during subsequent cutting across the joint.

DESCRIPTION OF THE INVENTION

When the shaped product is maintained in the cooled tool pair so that it hardens, according to the invention, the weld between two sheets is cooled at a reduced cooling rate in relation to the areas on either side of the weld so that a narrow, soft area is formed along the weld. The weld and the area immediately around the weld then have a lower martensite content than the rest of the product, resulting in a narrow, soft area with lower yield point and tensile strength and an elongation at break which is considerably higher than it would have been had the weld been hardened in the same manner as the rest of the product. The weld is critical in the event of a collision, and crack formation at the weld could be devastating to the desired deformation process and could reduce the energy absorption obtained by controlled deformation when the invention is not applied.

The desired reduction of the cooling rate can be achieved by means of a gap between the tool pair and the finished product alongside the weld. It is also possible to have a narrow heated part of the tool pair alongside the weld.

The invention claimed is:

1. A method of forming a product by shaping and hardening a sheet-steel blank comprising separate sheets welded together, the steps of said method including: heating the blank to the austenitising range, hot-stamping the blank in a cooled tool pair, hardening the product while it remains in the tool pair, and cooling the weld between two adjacent said sheets at a reduced cooling rate compared to the cooling rate of areas on either side of the weld such that said areas on either side of the weld are harder than the weld.

2. The method according to claim 1, wherein the step of cooling the weld at a reduced cooling rate includes the step of maintaining a gap between the tool pair and the product.

* * * * *